US008561602B2

(12) United States Patent
Andors et al.

(10) Patent No.: US 8,561,602 B2
(45) Date of Patent: Oct. 22, 2013

(54) GAS FEATURE AND METHOD

(75) Inventors: Derik Andors, Randolph, VT (US); Stephen F. Richardson, Randolph Center, VT (US); Douglas DeFouw, Moore, SC (US)

(73) Assignee: Agio International Company, Ltd., Hong Kong (HK)

( * ) Notice: Subject to any disclaimer, the term of this patent is extended or adjusted under 35 U.S.C. 154(b) by 951 days.

(21) Appl. No.: 12/653,793

(22) Filed: Dec. 21, 2009

(65) Prior Publication Data

US 2010/0154779 A1 Jun. 24, 2010

Related U.S. Application Data

(60) Provisional application No. 61/203,550, filed on Dec. 24, 2008.

(51) Int. Cl.

| | |
|---|---|
| ***F24B 1/181*** | (2006.01) |
| ***F23M 3/00*** | (2006.01) |
| ***F23M 9/00*** | (2006.01) |
| ***F23Q 7/12*** | (2006.01) |

(52) U.S. Cl.
USPC ..... 126/512; 431/9; 431/183; 431/185; 126/519

(58) Field of Classification Search
USPC ..... 126/512, 519, 86, 93, 503; 431/353, 431/344, 125, 253, 183; 326/180, 57, 159, 326/312, 171, 320, 96
See application file for complete search history.

(56) References Cited

U.S. PATENT DOCUMENTS

| | | | | |
|---|---|---|---|---|
| 3,644,726 | A * | 2/1972 | Pfeuffer | 40/406 |
| 3,746,499 | A | 7/1973 | Guerre et al. | |
| 4,105,393 | A | 8/1978 | Boylett | |
| 5,310,337 | A | 5/1994 | Lifshits et al. | |
| 5,735,687 | A | 4/1998 | Knopfel et al. | |
| 6,234,785 | B1 | 5/2001 | Kim et al. | |
| 6,901,760 | B2 | 6/2005 | Dittmann et al. | |
| 6,951,454 | B2 * | 10/2005 | Sarv et al. | 431/9 |
| 7,566,218 | B2 * | 7/2009 | Aldrich | 431/185 |
| 2004/0261780 | A1 * | 12/2004 | Frink et al. | 126/92 B |
| 2007/0224562 | A1 | 9/2007 | Hiromitsu et al. | |

FOREIGN PATENT DOCUMENTS

| | | |
|---|---|---|
| EP | 0428174 | 11/1990 |
| GB | 1 346 230 | 5/1971 |
| JP | 2007-255795 | 10/2007 |
| WO | WO 2008/112379 | 9/2008 |

OTHER PUBLICATIONS

"Experimental Database for Premixed Turbulent Flames"; http://eetd.lbl.gov/act/combustion/workshop/Database/flam-config.html; 2009; pp. 1-8.

(Continued)

*Primary Examiner* — Kang Hu
*Assistant Examiner* — Vivek Shirsat
(74) *Attorney, Agent, or Firm* — Williams Mullen

(57) ABSTRACT

Gas fire devices are provided that produce a swirling flame by passive means using the kinetic energy of gas exiting through burner ports located in a burner and the kinetic energy of air drawn through louvers or flaps radially positioned on the base of a plenum. Situated above the burner and plenum is a chimney, which surrounds the flame and may be a translucent or transparent material to help observers better see the flame.

22 Claims, 13 Drawing Sheets

(56) References Cited

OTHER PUBLICATIONS

Zhang et al; "Flow Field in Swirl-Type Tubular Flame Burner"; JSME International Journal Series B, vol. 48; No. 4; 2005; pp. 830-838; http://www.jstage.jst.go.jp/article/jsmeb/4/4/48_830/_article.

Zhang; "Lean Blowoff Characteristics of Swirling H2/CO/CH4 Flames"; Georgia Institute of Technology; 2008; pp. 1-3.

Fleming; "Plant Engineer's Reference Book (2nd Edition)"; Chapter 13 Gas; 2003; 16 pages.

Conto et al; "Domestic Range Burner Design Procedure"; The Seventh Asia-Pacific International Symposium on Combustion and Energy Utilization; Dec. 15-17, 2004; Hong Kong SAR; 8 pages.

Eddings; "Mechanical Engineers' Handbook Third Edition Energy and Power"; Chapter 16 Combustion; 2006; 56 pages.

Engineering Guide; Eclipse Combustion; Copyright 1986; EFE 825, Aug. 2004; pp. 1-118.

New Table-top Fire Pits using Venturi Flame Technology; Outdoor GreatRoom®; 2 pages; http://www.outdoorrooms.com/our-company; color images; Mar. 11, 2010.

Venturi Flames Fires; http://outdoorrooms.com/store/fire-pits-fireplaces/venturi-flames-fires.html; 1 page; color images; Mar. 11, 2010.

* cited by examiner

GAS FEATURE AND METHOD

CROSS-REFERENCE TO RELATED APPLICATION

The present application claims the benefit of priority from U.S. Provisional Application Ser. No. 61/203,550, filed Dec. 24, 2008, which is incorporated by reference.

FIELD OF THE INVENTION

This invention relates to the field of indoor/outdoor furniture, including patio or balcony appliances. More particularly, the invention relates to devices that produce a swirling gas flame, such as torches, fireplaces, heaters, table displays, etc.

BACKGROUND

People have always been fascinated by fire. Its light and energy provide very useful benefits, and its movement and appearance have pleased countless gazers in a variety of settings, from campgrounds to living rooms. The natural movement of fire provides an almost-lifelike appearance, which contributes substantially to its beauty.

Amplifying the movement of flames can generate an even more pleasing look for observers. One such manner of amplification is to swirl the flame. Swirled flames can have an almost helical look.

Present designs of 'swirling flame' gas fireplaces (or similar such aesthetic and/or useful features) rely largely on imparting kinetic energy to a gas in order to cause the flame to move in rotary motion. For example, some approaches use an electric fan to rotate air and any flame that is generated. See, e.g., U.S. Pat. No. 7,175,424. Of course, any mechanical or electrical breakdown would cause the flame to stop rotating and would therefore result in the complete loss of any visual, rotary effect.

Another conventional approach is to provide fireplace or torch with a flame situated within a clear, vertical chimney that admits air in a manner to cause the flame to swirl. In other words, the chimney function is merged with that of a plenum or burn chamber. A burner is positioned at the foot of the chimney. To create a moment about the vertical axis within the chimney, such a chimney is commonly square or rectangular with vertical air slots. Typically, the vertical air slot may be positioned consistently along the same vertical (e.g., leading) edge of each of the faces of the chimney. These vertical air slots admit air into the chimney for combustion. When the flame is started, combustion gasses begin to rise within the chimney. This rising flow creates a low pressure that pulls combustion air into the chimney/plenum. Because the air enters the chimney tangentially to the flame or vertical axis, the air will tend to twist the flame.

Although this approach is an improvement over artificial or mechanically created draft devices, it nevertheless presents some difficulties. The use of vertical air slots in the sides of a chimney requires the creation of a moment with respect to a vertical axis. This approach would likely be less effective in chimneys having shapes without edges, such as tubular (i.e., cylindrical) chimneys. Such slots would likely not have a geometric configuration favorable to generating swirling effects because the tangential orientation that creates a twisting moment would be difficult to structure or would be obtrusive/aesthetically unpleasing. Moreover, because the air enters along the combined chimney/plenum or chamber, the burner must be positioned at or near the same level as the slots in order to sustain full combustion at the burner. In other words, a chimney with vertical air slots must have a cross section that accommodates the plenum and burner so that replenishment air can reach the burner, thus limiting the design options available for such chimney. Thus, the burner structure is visible, which may not be desired for an aesthetic device and may require additional screening. Notably, the air slots within the chimney are openings that expose the flame. With an open flame, the level of safety of the apparatus may render it dangerous for use about children or the inattentive. Further, the air flowing into the chimney tends to compress the flame, which necessitates a form of burner gas diverter that redirects the fuel outwardly in order to add volume to the flame. When the swirl rotates away from a portion of the diverter, the flame at the portion will break down small flamelets until the flame rotates back. It is also expected that the entry of combustion air along the course of the chimney is self limiting in that the access for combustion air is at the same point as the combustion, so that it is believed that for a given level of combustion, less of a draft would be created.

Additionally, in some embodiments, gas flow is temporarily deflected in a radial direction by the use of a series of plates. See, e.g., WO 2008/112379 A1. In such embodiments, the upward movement for much of the gas is often completely halted as it impacts the lower plate and moves outward along it. Only after reaching the edge of the plate does the gas resume its upward movement, caused by its natural buoyancy. Hence, in such embodiments, some of the kinetic energy of the gas may not be fully utilized.

SUMMARY OF THE INVENTION

Disclosed is a gas fire feature that produces a swirling flame by passive means. Among other things, the fire feature may include a configuration of burner ports and louvers or flaps that complement each other to enhance the swirl pattern of gas exiting the burner ports. The fire of such a feature may be supplied by commercially available liquefied petroleum gas, for example.

The complementary burner ports and louvers or flaps respectively direct the combustible gas and air in an upward and swirling direction. The natural kinetic energy of the gas, provided by the gas source, is directed through the placement and orientation of the burner ports. The heat of the flame naturally draws air through the louvers or flaps, which direct the air in the desired direction. The flame may be maintained in a chimney located above the burner ports and louvers or flaps.

An aspect of the feature is a device that uses a natural draft or flow of air to create a gas flame that swirls about a vertical axis. The device includes a base and a chimney.

An embodiment of the base includes a stand, a plenum, and a burner. The stand may have at least one support member that defines an air passage in fluid communication with the surrounding air. This stand has a stand top that defines an opening that lies within the stand top. The base also has a plenum. This plenum has a plenum top, a plenum base, and at least one side, which together define a plenum chamber having a first effective diameter. The plenum may be mounted on the top of the stand with the plenum base engaging the opening in the top of the stand. The plenum base defines a plurality of louvers or flaps. These louvers or flaps are disposed in the plenum base in a radial direction with respect to the vertical axis. The louvers or flaps define a radial slits and scoops depending from the plenum base along the length of the slits. The louver is defined by a raised portion of the plenum base that contours the ends to remain attached to the base, essentially by stretching the metal at the ends of the louver. A flap is defined by a raised portion of the plenum base in which the ends are not connected to the plenum base and the metal is bent at the junction of the flap and the plenum base. Both the louver or flap configuration define slits that establish fluid communication between the stand opening and the plenum. The plenum top defines an outlet centered on the vertical axis with a second effective diameter. This second effective diameter is no greater than the first effective diameter. The base may also include a nozzle mix gas burner. This burner has a top, a bottom, and at least one side, the burner top, bottom, and at least one side thus define a burner chamber having a third effective diameter. The burner outer surface has with a perimeter. This burner outer surface also defines a plurality burner ports. Each of the burner ports has a central axis along the port, along which gas may flow. The burner ports may be angled so as to direct gas in a desired upward direction and a desired rotary direction with respect to the vertical axis. A gas inlet tube, in fluid communication with the burner chamber, may be connectable to a source of gas fuel to supply the burner. The third effective diameter is less than the first effective diameter and the burner is disposed within a lower portion of the plenum substantially centered on the vertical axis. This may leave a desired portion of the plenum base exposed about the burner. In this exposed area, the plurality of louvers or flaps may be disposed. In addition, the plenum base may further define a passage adapted to receive the gas inlet tube.

As noted above, the device also includes a chimney. An embodiment of the chimney defines a vertical flue with an upper end and a lower end, the chimney having a fourth effective diameter. The lower end of the flue may be operably engaged with the plenum outlet and thereby in fluid communication with the plenum chamber, with the chimney being substantially centered on the vertical axis.

An aspect of this embodiment is that the scoops may be inclined at such an angle, so that when air flows from the stand into the plenum via the louvers or flaps, then the air flow is angled in the same desired rotary direction as the gas.

Optionally, the burner ports and the scoops are oriented to direct gas and air flow in a clockwise direction or, conversely, in a counterclockwise direction.

In one version of the device, the third effective diameter is less than the second effective diameter. In another version, a vertical collar may be disposed about the plenum top outlet. In another version, a piezoelectric starter may be disposed within the plenum chamber and outside of the burner chamber. In another version, the chimney may be comprised of a transparent material.

Various dimensional and shaped alternatives are available. For example, the fourth effective diameter may be greater than the second effective diameter. The fourth effective diameter may be greater than the third effective diameter. In one embodiment, the burner chamber, the plenum chamber, and the chimney are substantially cylindrical and substantially centered about the vertical axis.

There may also be placement variation in the burner ports. For example, the plurality of burner ports may be disposed in the at least one side of the burner, or in the top of the burner.

In one embodiment, the gas burner outer surface defines a plurality of upward projections disposed in a substantially circular manner about the perimeter of the gas burner outer surface. Each of these projections has a rear incline and a front incline. The plurality of burner ports may be defined in the front inclines of the upward projections. In one version of this embodiment, each of the plurality of burner ports may be consistently disposed in substantially the same location relative to each respective vertical projection.

The device may incorporate or integrate various decorative, furnishing arrangements, such as a waterfall, a table, torch, or a torchiere.

In one of these arrangements, the device may further include an integrated waterfall device connected to the base, which forms at least one waterfall surface and defines at least one spillway in an upper end of the waterfall surface. Such a spillway is capable of spilling water along the waterfall surface in desired relation or manner. A water pump may engage with the waterfall device, and can be capable of pumping water from a pump inlet and out a pump discharge. In such an arrangement, the device may provide a water pump reservoir capable of holding water, with the water pump discharge being in fluid communication with the at least one spillway, the water pump reservoir being adapted to receive water spilling along the waterfall surface, and the water pump reservoir being in fluid connection with the water pump inlet.

Optionally, the at least one spillway of the above waterfall arrangement comprises two or more spillways, and the integrated waterfall device further defines a central, somewhat vertical channel interposed vertically between two spillways, and wherein at least a portion of the chimney is positioned within the central channel. In another option, the waterfall surface may define a plurality of somewhat horizontal corrugations.

In a torch or torchiere arrangement, the device may have a base that further includes an integrated casing disposed about at least a portion of the base, the casing having at least one casing support surface for supporting the base without preventing the stand's fluid communication with surrounding air, and one or more legs connected to and depending from the casing, thereby elevating the device in the manner of a torch.

In a table arrangement, the device may include an integrated table having a casing disposed about at least a portion of the base, and adapted to support the base without preventing the stand's fluid communication with surrounding air. Such a table may include a substantially horizontal table top, with the table top defining a horizontal hole positioned in the table top proximate the casing and centered on the vertical axis; at least one leg may depend from and be connected to the table for providing support. In this arrangement, the chimney may be substantially centered on the vertical axis and may pass through the hole in the table top. An optional version of this arrangement may have a table top of a transparent material.

An aspect of an alternative embodiment of the device also includes a base and a chimney.

An embodiment of this base includes a stand, a plenum, and a burner. The stand may have at least one support member that defines an air passage in fluid communication with the surrounding air. This stand has a stand top that defines an opening in the stand top. The base also has a plenum. This plenum has a plenum top, a plenum base, and at least one side, which together defines a plenum chamber having a first effective diameter. The plenum may be mounted on the top of the stand with the plenum base engaging the opening in the top of the stand. The plenum base defines a plurality of louvers or flaps. These louvers or flaps are disposed in the plenum base in a radial direction with respect to the vertical axis. The louvers or flaps define a radial slit and scoops depending from the plenum base along the length of the slits. The slits establish fluid communication between the stand opening and the plenum. The plenum top defines an outlet centered on the vertical axis with a second effective diameter. This second effective diameter is no greater than the first effective diameter. A vertical collar may be disposed about the plenum top outlet. The base may also include a nozzle mix gas burner.

This burner has a top, a bottom, and at least one side, the burner top, bottom, and at least one side define a burner chamber having a third effective diameter. The burner has an outer surface with a perimeter. This burner outer surface also defines a plurality burner ports. Each of the burner ports has a central axis along the port, along which gas may flow. The burner ports may be angled so as to direct gas in a desired upward direction and a desired rotary direction with respect to the vertical axis. A gas inlet tube, in fluid communication with the burner chamber, may be connectable to a source of gas fuel to supply the burner. The gas burner outer surface may define a plurality of upward projections disposed in a substantially circular manner about the perimeter of the gas burner outer surface. Each of these projections has a rear incline and a front incline. The plurality of burner ports may be defined in the front inclines of the upward projections. The third effective diameter may be less than the first effective diameter and the second effective diameter. In addition, the burner may be disposed within a lower portion of the plenum, substantially centered on the vertical axis so as to leave a desired portion of the plenum base exposed about the burner. The plurality of louvers or flaps may be disposed within the exposed portion of the plenum base. In addition, the plenum base may further define a passage adapted to receive the gas inlet tube.

As noted above, the device also includes a chimney. An embodiment of the chimney defines a vertical flue with an upper end and a lower end, the chimney having a fourth effective diameter. The lower end of the flue may be operably engaged with the plenum outlet and thereby in fluid communication with the plenum chamber, with the chimney being substantially centered on the vertical axis.

An aspect of this embodiment is that the scoops may be inclined at such an angle, so that when air flows from the stand into the plenum via the louvers or flaps, then the air flow is angled in the same desired rotary direction as the gas.

An aspect of an alternative embodiment of the device also includes a base and a chimney.

An embodiment of this base includes a stand, a plenum, and a burner. The stand may have at least one support member that defines an air passage in fluid communication with surrounding air. This stand has a stand top that defines an opening in the stand top. The base also has a plenum. The plenum has a plenum top, a plenum base, and at least one side, which together defines a plenum chamber having a first effective diameter. The plenum may be mounted on the top of the stand with the plenum base engaging the opening in the top of the stand. The plenum base defines a plurality of louvers or flaps. These louvers or flaps are disposed in the plenum base in a radial direction with respect to the vertical axis. The louvers or flaps define a radial slit and scoops depending from the plenum base along the length of the slits. The slits establish fluid communication between the stand and the plenum. The plenum top defines an outlet centered on the vertical axis with a second effective diameter. This second effective diameter is no greater than the first effective diameter. The base may also include a gas burner. This burner has a top, a bottom, and at least one side, the burner top, bottom, and at least one side define a burner chamber having a third effective diameter. The burner has an outer surface with a perimeter. This burner outer surface also defines a plurality burner ports. Each of the burner ports has a central axis along the port, along which gas may flow. The burner ports may be angled so as to direct gas in a desired upward direction and a desired rotary direction with respect to the vertical axis. A gas inlet tube, in fluid communication with the burner chamber, may be connectable to a source of gas fuel to supply the burner. The gas burner may be disposed within a lower portion of the plenum, substantially centered on the vertical axis so as to leave a desired portion of the plenum base exposed about the burner. The plurality of louvers or flaps may be disposed within the exposed portion of the plenum base. In addition, the plenum base may further define a passage adapted to receive the gas inlet tube.

As noted above, the device also includes a chimney. An embodiment of the chimney defines a vertical flue with an upper end and a lower end, the chimney having a fourth effective diameter. The lower end of the flue may be operably engaged with the plenum outlet and thereby in fluid communication with the plenum chamber, with the chimney being substantially centered on the vertical axis. The fourth effective diameter may be greater than the second and third effective diameters.

Additionally, the scoops may be inclined at such an angle, so that when air flows from the stand into the plenum via the louvers or flaps, the air flow is angled in the same desired rotary direction as the gas.

DETAILED DESCRIPTION

An aspect of this gas feature is to produce a swirling flame by passive means. By passive, it is meant that the device does not require a power source in order to impart additional kinetic energy to the gas, or to the air mixing with the gas, for the purpose of causing a rotary motion of a swirling flame.

Figure 1:
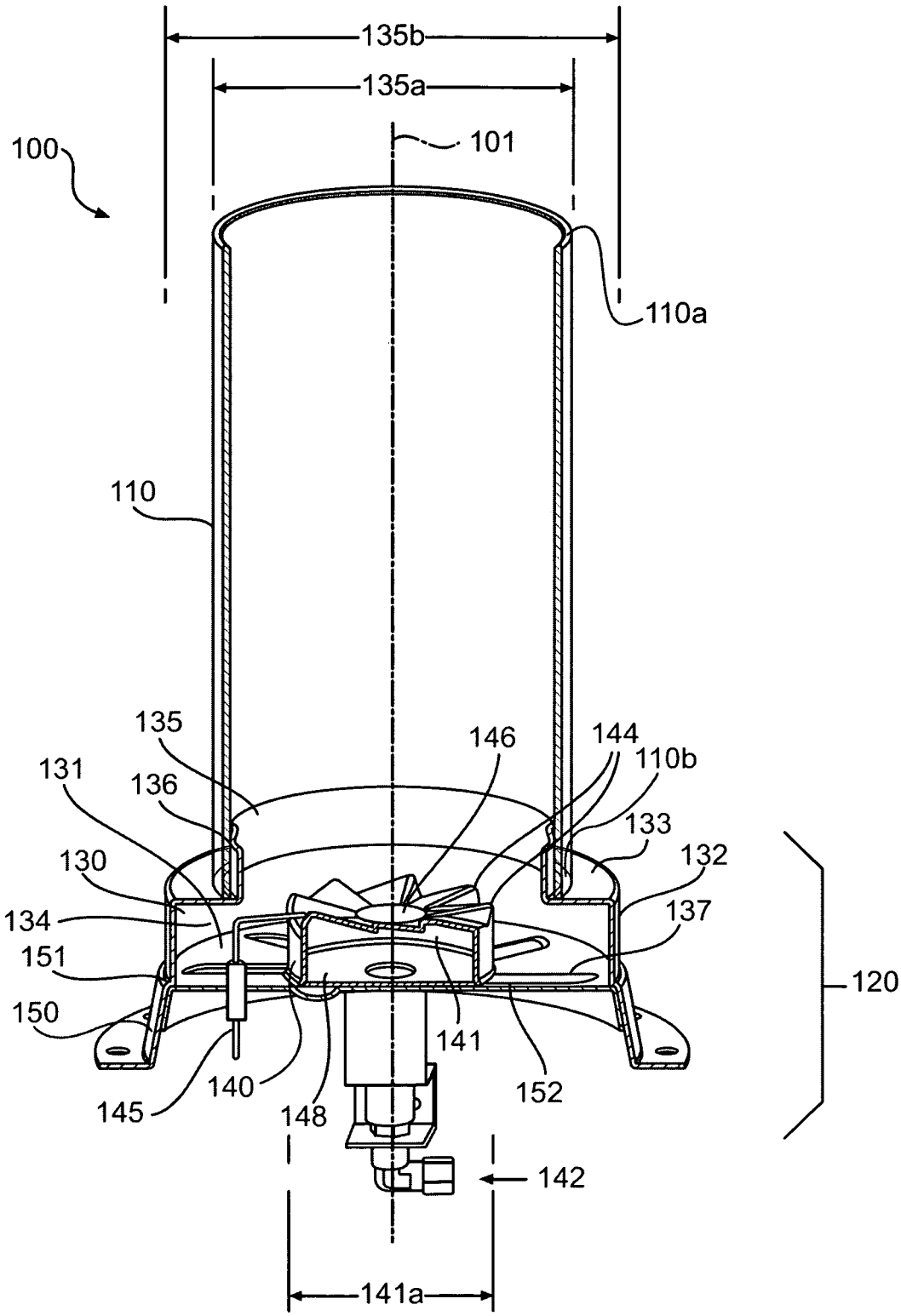
FIG. 1 is side view cutaway.

With reference to the figures, and FIG. 1 in particular, an aspect of the device 100 is a decorative and useful gas feature having a centrally located vertical axis 101 and a chimney 110 defining a vertical flue having an upper end 110*a* and a lower end 110*b*, the chimney 110 being substantially centered on vertical axis 101. Device 100 also includes a base 120, to be used with a combustible gas supply system (not shown in FIG. 1), such as commercially available liquefied petroleum gas, for example. Other types of combustible gas systems may also be used. The base 120 comprises a plenum 130, a burner 140, and a housing or stand 150 having a stand top 151 defining a stand top opening 152. Housing or stand 150 is simply sufficient structure for the support of plenum 130 (i.e., and thus the remainder of device 100) and to enable the engagement or integration of stand top opening 152 with a plenum base 131. An aspect of stand 150 is that it permits fluid communication of air up to plenum base 131. Thus, stand 150 may take the form of an open frame, such as wire legs with a wire top, or a bracket or other support member. Alternatively, stand 150 may take the form of an otherwise enclosed, stand-alone housing or casing, vented to enable stand-alone housing, a bracket or other support, etc., with each embodiment leaving or defining sufficient air passage (not shown) to permit fluid communication of air up to reach plenum base 131. This variability enables the integration of the device 100 with various decorative or furniture items, as described below.

The burner 140 defines a burner chamber 141 that is in fluid communication with a gas inlet tube 142, for the supply of gas from the supply system into the burner chamber. The gas inlet tube 142 should form a secure fit with both the gas source and the burner chamber 141. An aspect of an embodiment of burner 140 is to be "nozzle mix," in that gas and air mix after gas exits the burner (i.e., as opposed to pre-mixing the air and the gas prior to exiting the burner); air inlet pilot holes or other sources of air leakage in tube 142 may disadvantageously introduce excess air, depending on the design. A control valve 143 (not shown in FIG. 1; see FIG. 7) may be used to control the supply of gas. Burner ports 144 may be disposed on burner 140, through which gas from burner chamber 141 may be passed via fluid communication into plenum 130. In one embodiment, each burner port 144 has a burner port axis 144*a* (see FIG. 2), and are distributed about the burner chamber 141. The burner ports 144 may thus be configured on burner 140 so as to admit gas under pressure into the plenum 130 in a desired swirl pattern. As shown in FIG. 1, the burner 140 and corresponding burner chamber 141 may be centrally located in plenum 130 in order to facilitate radial flow within the plenum 130. Alternatively, burner 140 may define a chamber 141 that is at least partially recessed in or contiguous with plenum base 131.

The plenum 130 comprises plenum base 131, one or more sides 132, and a top 133 defining a plenum chamber 134 and plenum outlet 135. Plenum 130 may take a variety of shapes; however, a generally circular plenum chamber 134 (i.e., having a first effective diameter) is believed to enhance swirling airflow, as described further below. The plenum outlet 135 may also be circular and may have a second effective diameter the same, or in order for plenum outlet 135 to form a restriction or nozzle, less than the first effective diameter of the circular plenum chamber 134. A vertical collar 136 may be disposed about the perimeter of the plenum outlet 135.

The term "effective diameter" is a general reference to the approximate diameter of a circle that would have about the same cross sectional area as the cross sectional area in question. Effective diameter may thus refer to the cross sectional area of various portions of the present invention. For example, with respect to a circular embodiment, plenum chamber 134 would have the same (first) effective diameter as the actual diameter. However, a polygonal embodiment of plenum chamber 134, such as a rectangle having sides with lengths $L_1$ and $L_2$, would have an effective diameter $D_e$ as follows:

$$D_e = 2\sqrt{\frac{L_1 L_2}{\pi}}$$

The foregoing should be qualified with a general design principle that, for example, plenum chamber 134 is unable to define a plenum outlet 135 with a cross section area that goes beyond the bounds of the cross sectional area of plenum chamber 134; by definition, if it did it would not serve as an 'outlet' of plenum chamber 134.

The burner 140 may be disposed within the plenum 130, with 'disposed' simply meaning that burner 140 relates to plenum 130 in a manner so as to be able discharge gas into the plenum. Burner chamber 141 may be considered as having a third effective diameter. For embodiments in which burner 140 is disposed within plenum 130 as shown in FIG. 1, then the third effective diameter is less than the first effective diameter. In some embodiments, the third effective diameter may also be less than the second diameter of plenum outlet 135, which in some embodiments may avoid interaction of a swirling flame with plenum top 133.

Chimney 110 may be considered as having a fourth effective diameter. In some embodiments, the fourth effective diameter may be greater than the second effective diameter. The fourth effective diameter of chimney 110 may also be greater than the third effective diameter of burner chamber 141.

Preferably a starter 145 may be located in the plenum 130. The starter 145 may be conventional, such as a piezoelectric electrode coupled to an actuation system, or simply a manual lighting port in the plenum side for lighting the gas. Any suitable starter may be used.

The plenum base 131 defines a plurality of louvers (or flaps) 137 (for clarity, herein louver 137 defines both a louver or flap configuration) configured to admit air into the plenum 130 for combustion. The chimney 110 may be in the form of a tubular structure mounted about the plenum outlet 135. The chimney 110 may be made of glass or other transparent or translucent material that may sustain the contemplated temperatures. The plenum 130 and burner 140 may be made of metallic materials. For example, stainless steel may be employed for plenum base and burner components to be used outdoors.

The configuration of the burner ports 144 and the louvers 137 may complement each other to enhance the swirl pattern of the gas exiting the burner ports.

For example, in one embodiment (see FIG. 2), the burner 140 may have a burner top 146 that defines a number of upward projections such as stepped teeth 147, which may be similar in appearance to the teeth of a face gear that is used with a pawl. These teeth 147 may have a steep, nearly vertical front incline or face 147*a* and a somewhat more gradually angled, incline or back face 147*b*, along with an outer face 147*c*. The teeth 147 may be disposed radially about the perimeter of burner 140 outer surface, in a circular manner about the top 146, thereby forming a circle of teeth with the front faces 147*a* facing the back faces 147*b*. If the burner ports 144 are disposed within the front face 147*a*, then gas can be discharged out of the burner ports and onto the inclined back faces 147*b*, which passively forces the gas up and away from the burner 140, enhancing the swirl pattern. The ports 144 thus can be configured so that gas is discharged at an angle up from the horizontal. In addition, the teeth 147 and the burner ports 144 may be configured to discharge gas away from the tangential direction, in an outward direction into the plenum 130. In this embodiment, the burner top 146, burner bottom 148, and one or more burner sides 149 form the burner chamber 141.

Alternatively, ports 144 or teeth 147 with ports 144 may be disposed on the side of burner 140.

In some embodiments, each of the gas ports 144 is located in the same position on its respective burner stepped tooth 147. This commonality of location can improve the movement and appearance of the flame 160 by producing a consistent swirl pattern. In some embodiments, the common position for the burner port 144 is located on the front face of the tooth 147*a* at or near the intersection of the front face, the back face 147*b*, and the outer face 147*c* of the tooth 147. Distributing the ports 144 about the perimeter of the burner 140 in this fashion also improves the mixing of gas with combustion oxygen, which generally exists in greater amounts at the perimeter of a vortex, as opposed to its center, which is typically a low-pressure zone.

An aspect of teeth 147 is to enable better control of the gas flow without the need for a more substantial burner having tubes/nozzles and/or injectors. This may provide both simpler (and less expensive) production of burner 140 and for a more pleasing aesthetic appearance for various flame-generating products. For example, the embodiment shown in the figures involves a burner 140 fabricated of stamped metal components, with burner ports 144 drilled at the desired location. Of course, other fabrication approaches may be used, such as casting, but stamping has been found to be particularly economical. The tubes, nozzles, and/or injectors that are discussed above may also be used with the invention, if desired for the application.

In one embodiment (see FIG. 3), the plenum base 131 has louvers 137 that may be disposed radially with respect to vertical axis 101, in such a manner to admit air that flows in a direction that enhances or reinforces the swirl pattern of the gas exiting the burner ports 144. In the toothed embodiment, the gas is discharged from the burner ports 144 in a flowing rotary pattern (i.e., clockwise or counterclockwise, as viewed from above along vertical axis 101), upward and away from the burner ports.

Figure 3:
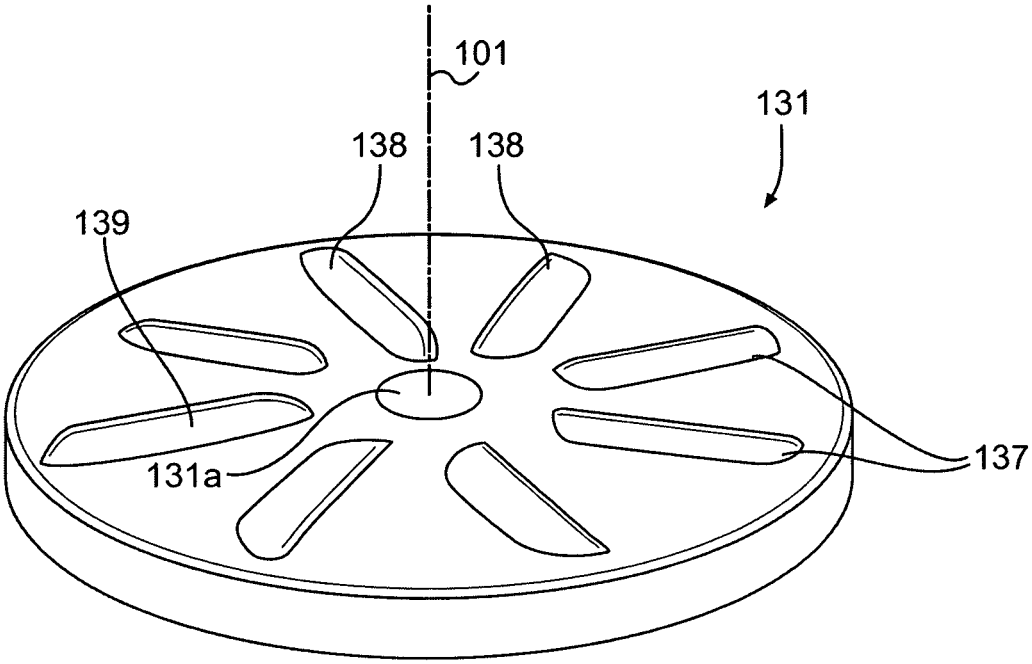
FIG. 3 is a perspective view of the plenum base, from slightly above the plenum base.

The louvers 137 of the plenum base 131 may be configured to produce a flow of air that matches the clockwise or counterclockwise flow of gas. FIG. 3 shows a detailed view of an embodiment of the plenum base 131 and the louvers 137 therein. As shown in the figure, the plenum base 131 includes a plurality of louvers 137. In the exemplary embodiment, eight louvers 137 are included. But other numbers of louvers 137 may also be used, e.g., six or ten, so long as enough are included so as to achieve the desired swirling effect for the air entering the plenum base 131.

In one embodiment, the louvers 137 define radially disposed slits 138 with radially disposed scoops 139 depending from the plenum base 131 along the length of the slits 138. Slits 138 establish fluid communication between plenum 130 and surrounding air via stand 150. The scoops 139 are configured at such an angle to draw air into the plenum 130 in a swirl pattern or rotary direction similar and complementary to the swirl pattern or rotary direction of the gas exiting the burner ports 144. Upon starting a flame 160 (not shown in FIG. 1; see FIG. 6), the combustion will produce warm gases that flow out of plenum 130 and into the chimney 110, which also creates a low pressure area above the plenum base 131. Air from below the plenum base 131 may flow along the louver scoops 139, through the louver slits 138 and into the plenum 130 to supply the ongoing combustion. As the flame 160 becomes established, the flow of air through louver slits 138 stabilizes into a rotary swirl that complements or reinforces the initial swirl created by the configuration of the burner 140.

Figure 5:
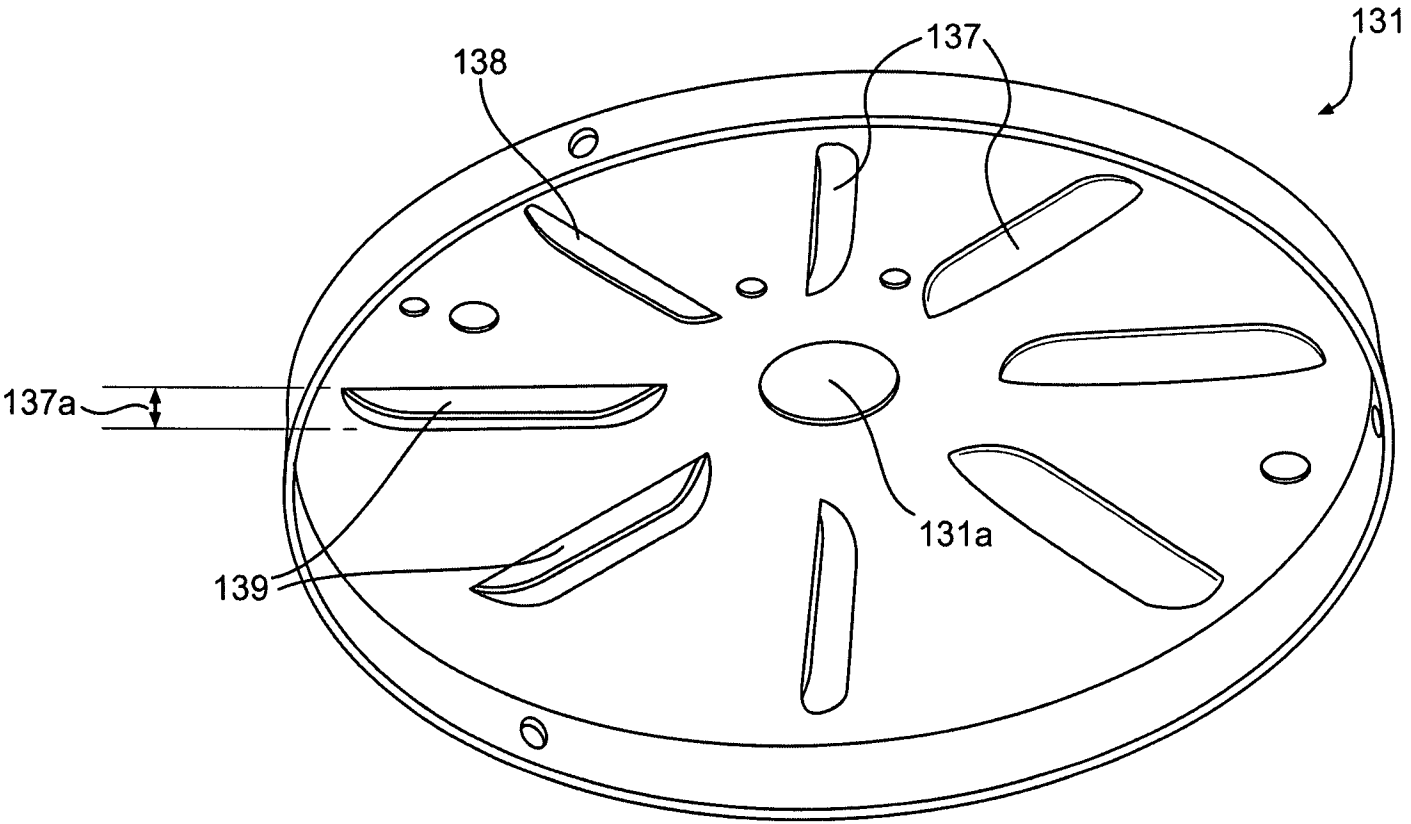
FIG. 5 is a perspective view of the plenum base, from slightly below the plenum base.

Each of the louvers 137 may be disposed in the plenum base 131 in a substantially radial orientation, and may be located substantially between a centrally located gas entry port 131*a* and the outward edge of the plenum base. (The gas entry port 131*a* permits the plenum base 131 to be configured in a manner with the burner 140 that allows fluid connection of the gas inlet tube 142 with the burner chamber 141.) An aspect is that louvers 137 may include scoop 139 to facilitate the entry of air along a desired direction through corresponding louver slit 138. The scoops 139 may be straight (i.e., ramping) or may have a curved (i.e., C-shaped) shape. The scoops 139 are configured in a way that creates gaps 137*a* between the scoops and the plenum base 131 (see FIG. 5). Gaps 137*a* may have a variety of sizes, depending on the application; in the embodiments shown, gaps of less than 5 mm were functional, but gaps of 5.2 mm to 5.5 mm were found to enhance the air flow and the movement and appearance of desired swirling flame 160.

FIG. 3 is a perspective view from slightly above the plenum base 131, with the scoops 139 positioned below, rather than above, the upper surface of the plenum base. This results in the scoops 139 depending into the stand 150. Such a configuration prevents the scoops from interfering with swirling air and gas flow within the plenum 130.

Figure 2:
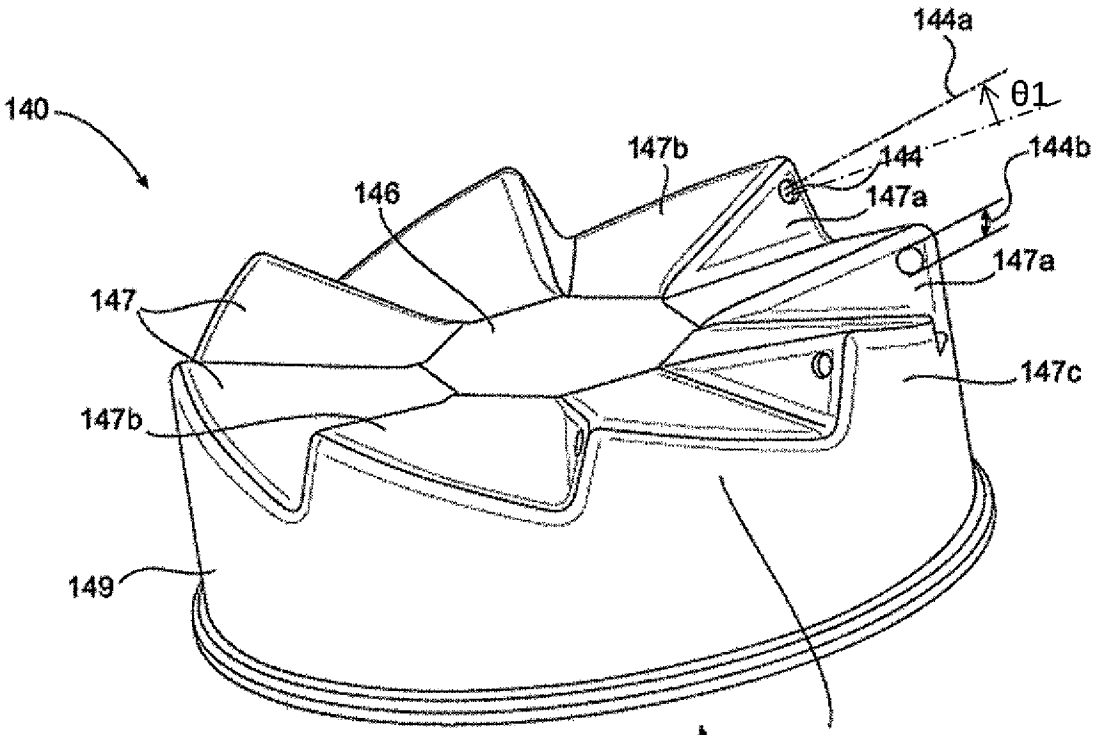
FIG. 2 is a detail of the burner.

FIGS. 2-5 provide additional illustrations. FIG. 2 includes a detailed view of an embodiment of a burner 140. As shown in the figure, this embodiment includes angled front faces 147*a* to create angled configurations for the gas burner ports 144. The ports 144 may be angled in a vertical direction, a horizontal direction, or both.

The magnitude of the vertical angle θ1 (see FIG. 2), determines how much of an upward direction at which the gas leaves the ports 144. In general, the vertical angle θ1 may range from about zero to about 90 degrees. Although some embodiments may be structured to accommodate a θ1 of about 90 degrees, such a large angle would be considered generally suboptimal, in that such upwardly directed gas would contribute little, if anything, to a rotary or swirling effect.

Figure 4:
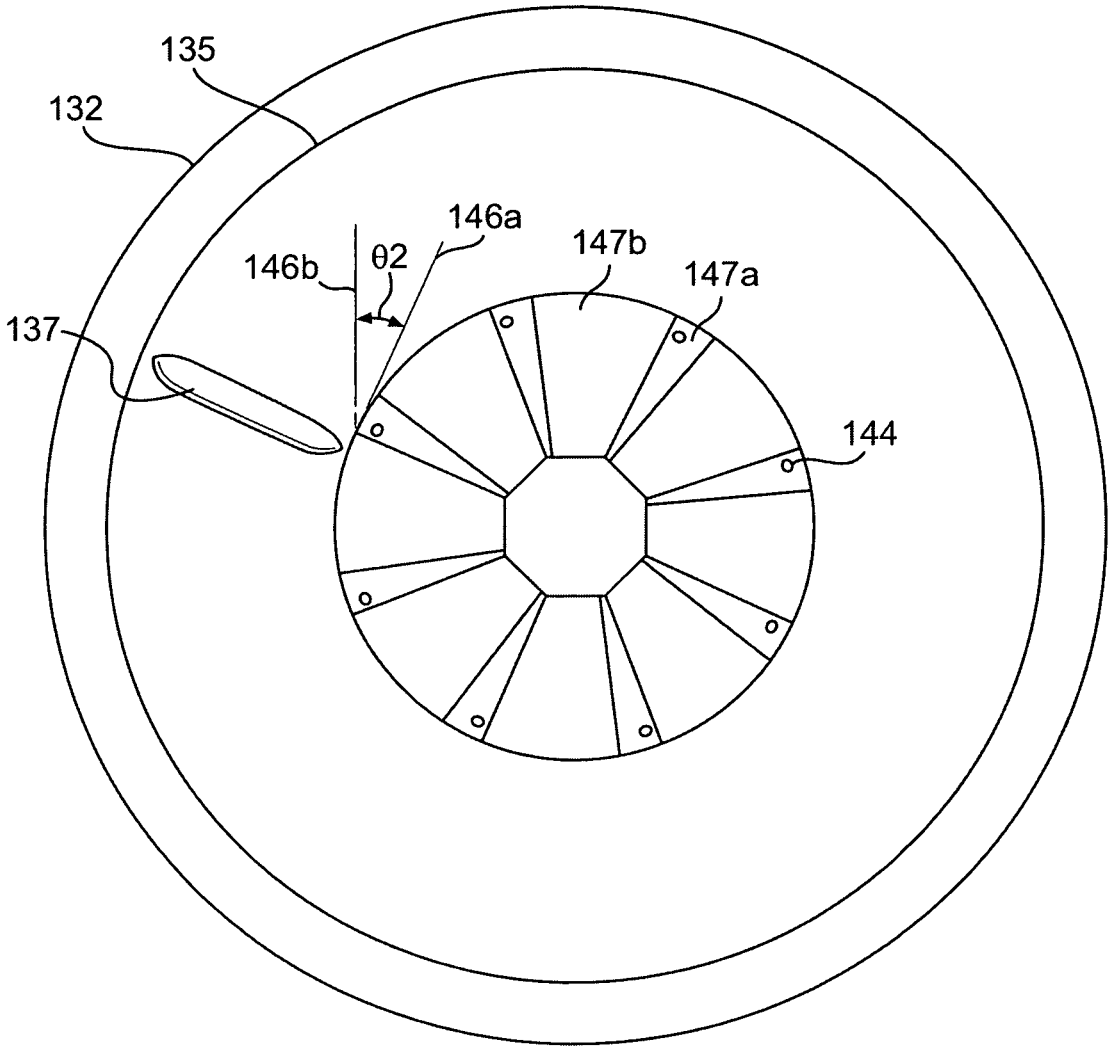
FIG. 4 is a top view of the burner, plenum outlet, and plenum side.

The magnitude of the horizontal angle θ2 (see FIG. 4) determines the extent to which the gas leaves the ports 144 in an outward direction, i.e., more of a radial direction is more directly toward the plenum side 132. As shown in FIG. 4, which is a top view of burner top 146 and plenum outlet 135, the range for horizontal angle θ2 may typically extend from about zero, (i.e., a conventional tangent line 146*a*), to a greater magnitude such as about 90 degrees, shown by line 146*b*, which would send the gas in a more outward direction. Although some embodiments may be structured to accommodate a θ2 of about 90 degrees, such a large angle would be considered generally suboptimal, in that such outwardly directed gas would contribute little to a swirling effect. On the other hand, in certain embodiments, it may be desirable for θ2 to be a negative value (i.e., directed somewhat inwardly from a conventional tangent), depending on a number of factors, such as arc of the gas plume dispersion as the gas exits the ports 144. As a general principle, however, embodiments having a larger negative θ2, such as −45 degrees, coupled with a narrow arc (i.e., a tight jet) of a gas plume, would require additional structural direction because the gas would be directed away from the surrounding louvers 137; in addition, such an embodiment would be prone to interference among multiple jets.

As disclosed, θ2 is the angle as measured from a conventional tangent. There can be some θ2 values that are 'negative' with respect to tangent. The normal gas plume dispersion for the primary embodiment would be rather broad or wide and may allow that some portion of the gas would flow somewhat in from a tangent.

These horizontal and vertical angles may be set as desired to achieve various types of rotary or swirling movement for the flame 160. In some embodiments, the vertical angles θ1 for each of the front faces 147*a* and the ports 144 are the same.

In some embodiments, the horizontal angles θ2 for each of the front faces 147*a* and the ports 144 are the same.

For the low cost, stamped embodiment shown in the figures, ports 144 may be formed by drilling in front faces 147*a*, thereby creating an orifice. In this configuration, given the typical pressures of commercially available gas supplies, the gas plume generally forms with an arc that is larger than that which might be formed by a more substantial or controlling nozzle. Of course, pressure variations may alter the characteristics of the gas plume as well. However, such arcs may be effectively controlled by the angle of back faces 147*b*. Back faces 147*b* may be angled upwardly in a way that assists in directing gas upwardly towards the plenum outlet 135, in a swirling direction. In some embodiments, the vertical angle of the front faces 147*a* (and corresponding ports 144) is the same or substantially the same as the degree of slope θ3 (measured in degrees above the horizontal plane 102; see FIG. 2) of the back faces 147*b*.

The structures described above can be used in a variety of methods of operation. For example, with particular reference to FIG. 1, one embodiment of the device 100 may employ the following exemplary method of operation:

(i) Gas enters the burner 140 through the burner gas inlet tube 142 and exits the burner 140 through a plurality of gas ports 144 in the burner 140, shown in this embodiment as being located on burner top 146. The ports 144 may be angled in an upward direction of 0 degrees to 90 degrees from the horizontal plane. This may be considered the step of providing a burner 140 and plenum 130, admitting a combustible gas into the plenum through a plurality of angled gas ports 144 in the burner 140, and inducing an angled flow in the gas. The ports 144 may be angled from 0-90 degrees from the radial in combination or separate from 0-90 degrees from the vertical plane.

(ii) Combustion air enters the plenum 130 through a plurality of louvers 137, optionally arranged in a substantially radial pattern in the plenum base or "swirl plate" 131. The burner ports 144 and louvers 137 (i.e., including scoop 138 orientation and angle) may be directed to producing either a clockwise or counterclockwise rotary direction (as viewed from above). This may be considered the step of providing air or oxygen through a plurality of angled louvers 137 consistent or complementary to the plurality of angled ports 144.

(iii) The plenum outlet 135 may have a reduced cross section to increase the velocity of air and gas, and to impart a very tight swirl to the flame 160 (see FIG. 6) as it rotates about the vertical axis 101 (FIG. 1). This may be considered the preliminary step of providing the plenum 130 with a first cross section wherein the plenum defines a plenum outlet 135 having a second cross section, and further wherein the first cross section is larger than the second cross section.

(iv) In operation, the flame 160 increases in height as the optionally glass chimney 110 heats up, further inducing a draft. Heat resistant polymers or other suitable materials may also be used as materials of construction for chimney 110, so long as they are selected or matched to be appropriate for the contemplated temperatures. A blower is not required to produce the swirling flame 160. This may be considered the preliminary step of providing a chimney 110 operatively engaged with the plenum outlet 135.

The many available embodiments permit a broad range of applications. For example, the gas feature may include the structure of a decorative or useful torch or touchier, possibly having a gas container that is smaller than the conventional 4.73-gallon tank. It is contemplated that the present invention may include an integrated table, such as being inset into a variety of table styles with, in some embodiments, having a chimney that passes through a hole in the table top. In another embodiment, a coffee table may have open or transparent elements, such as a transparent chimney and table top, by which the swirling flame may be viewed. Of course, such an application may be available for balcony tables, side tables, dining tables, etc. The gas feature may be provided as stand alone embodiments as well, such as sconces, fireplaces, braziers, or lamps. One embodiment, for example, may be a decorative table top design. Another embodiment may be a fireplace of such a scale as to provide useful warming of the surrounding area.

Figure 6:
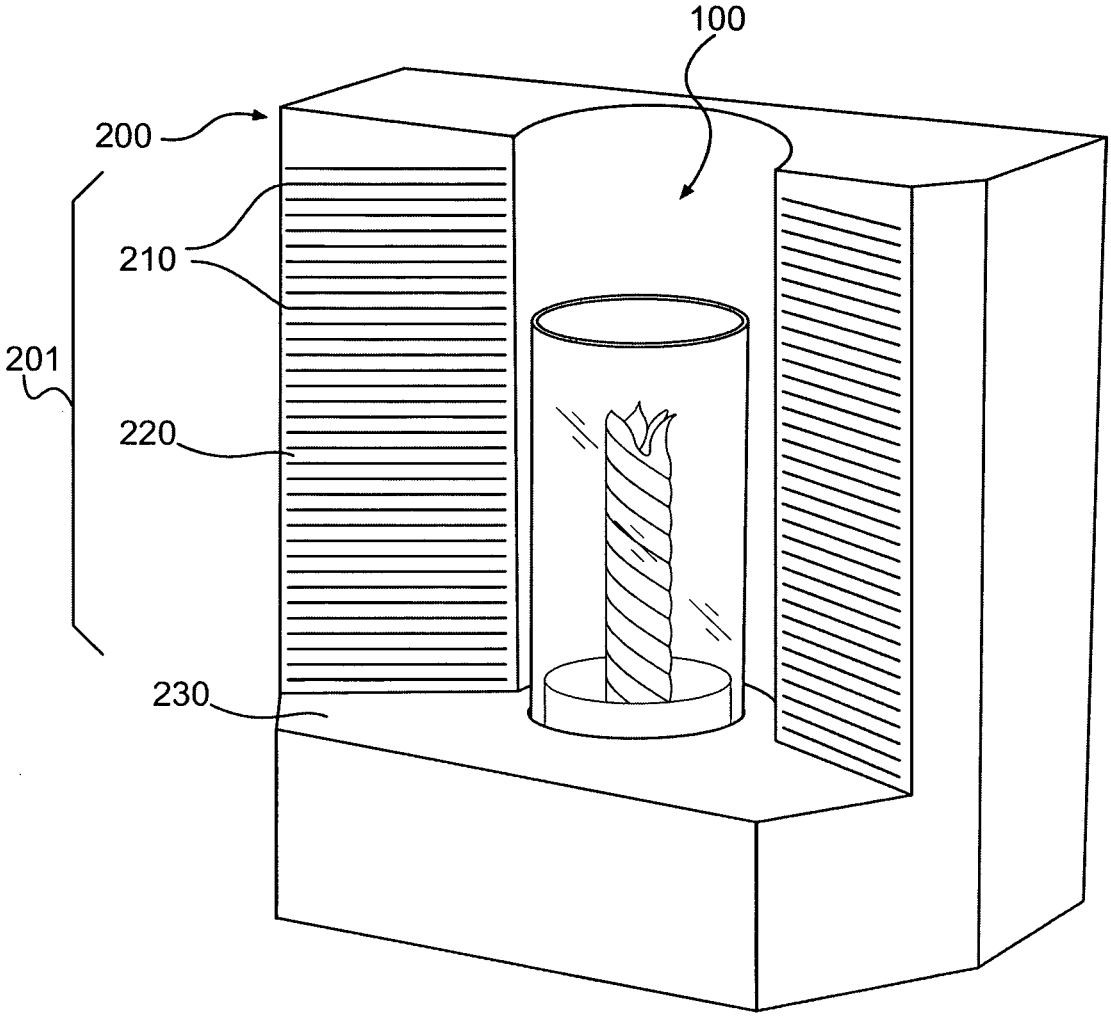
FIG. 6 is a perspective view of a gas feature and waterfall device.
Figure 7:
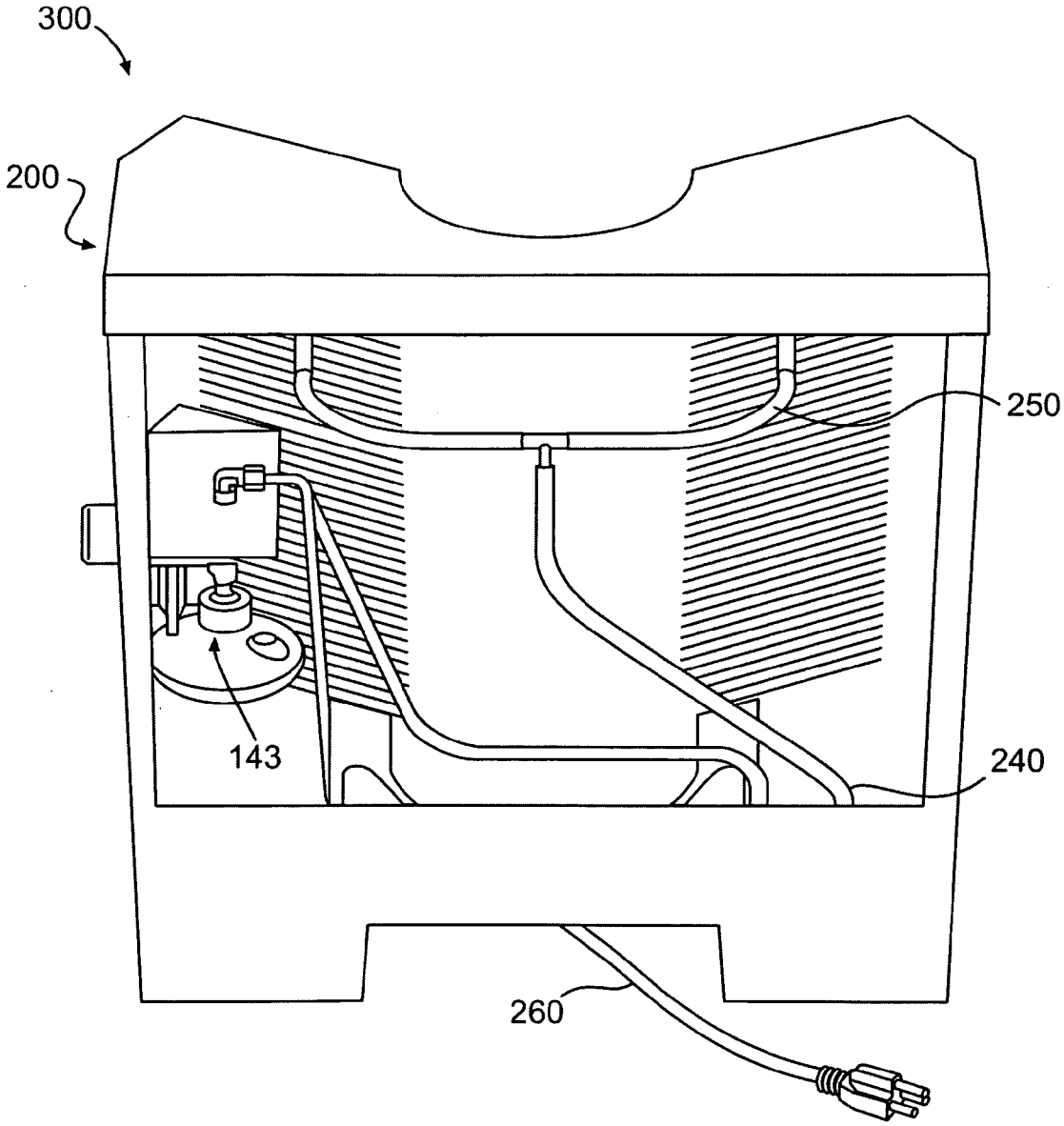
FIG. 7 is a slightly elevated rear view of the gas feature and waterfall device of FIG. 6.
Figure 8:
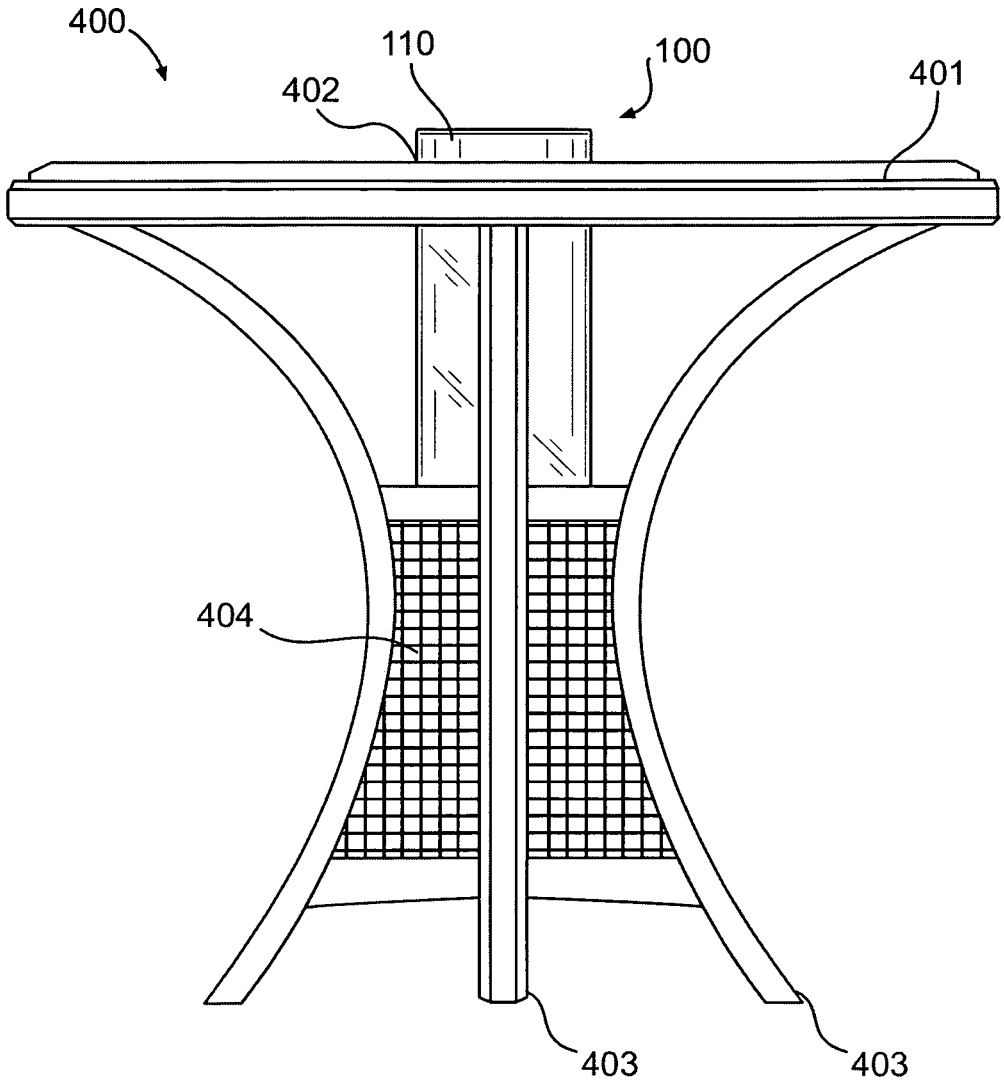
FIG. 8 is a side view of a table embodying the invention.
Figure 9:
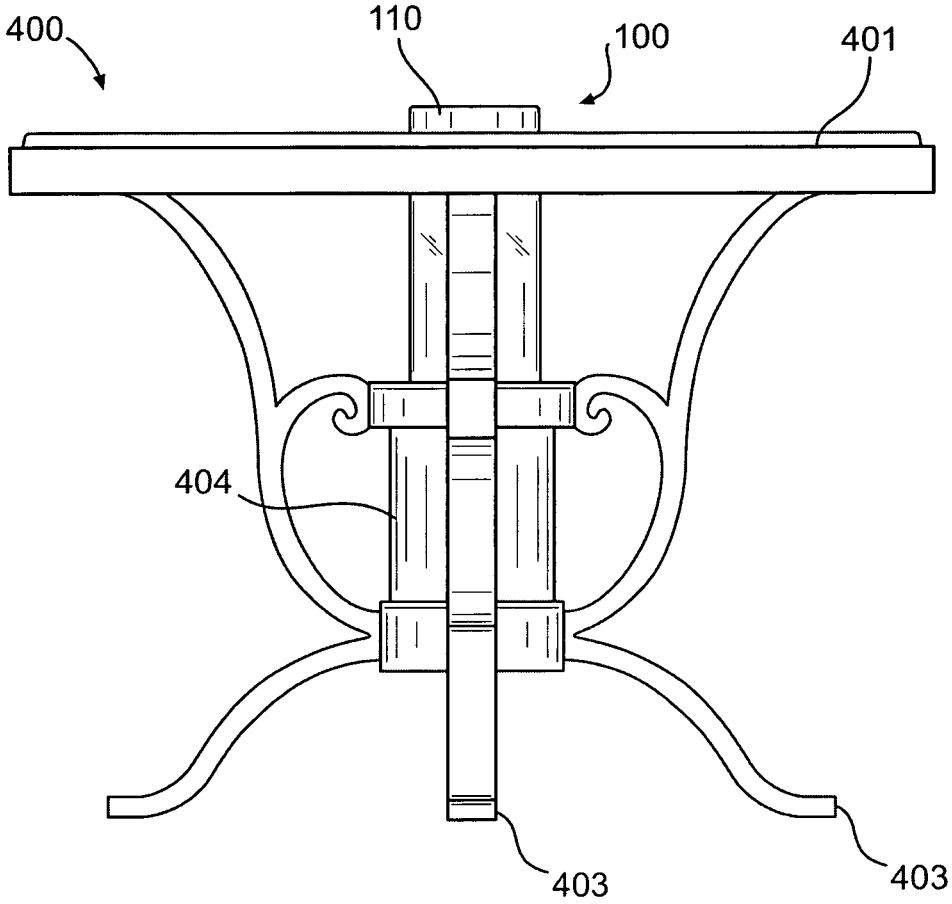
FIG. 9 is a side view of another table embodying the invention.
Figure 10:
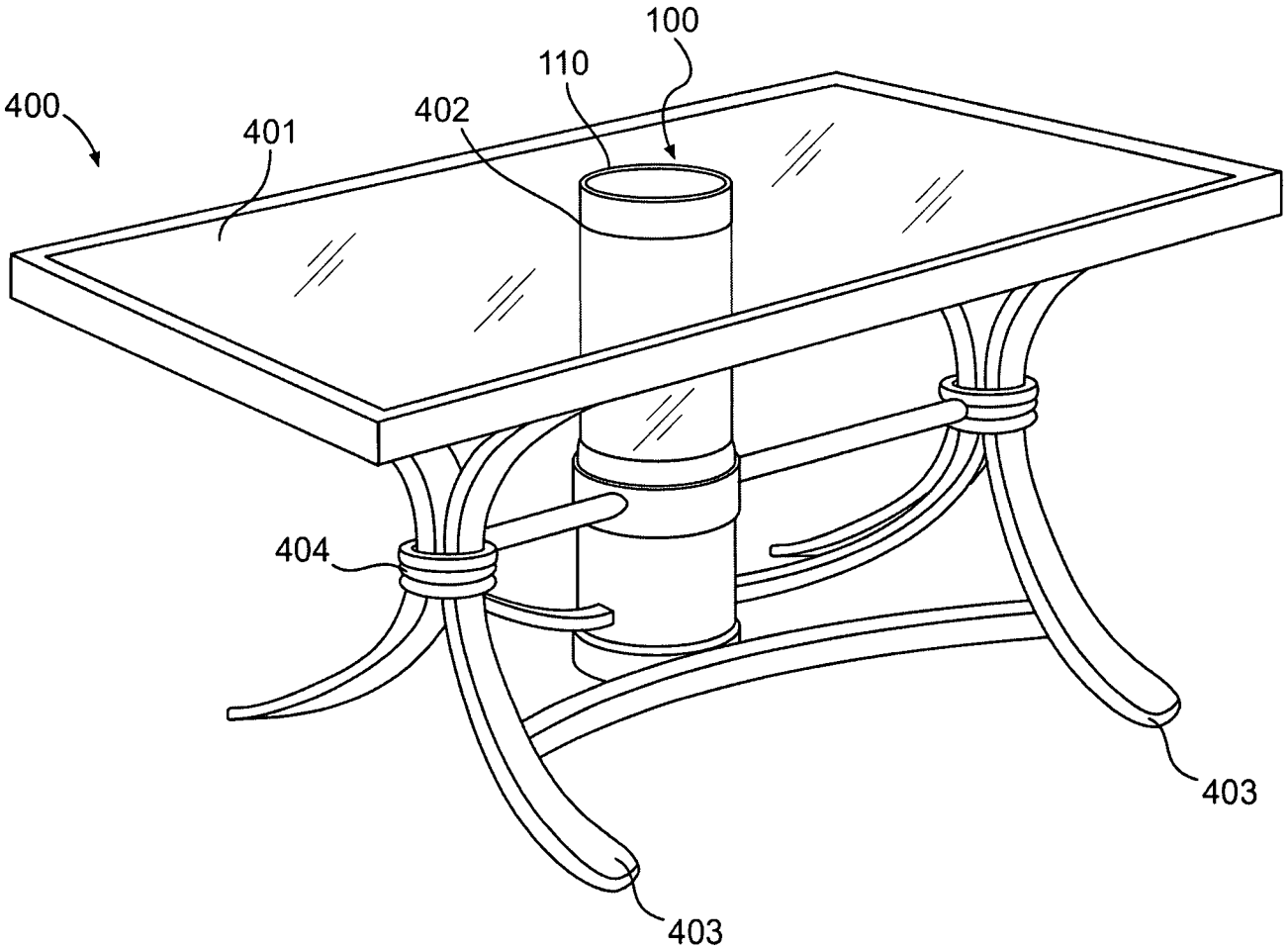
FIG. 10 is a perspective view of another table embodying the invention.
Figure 11:
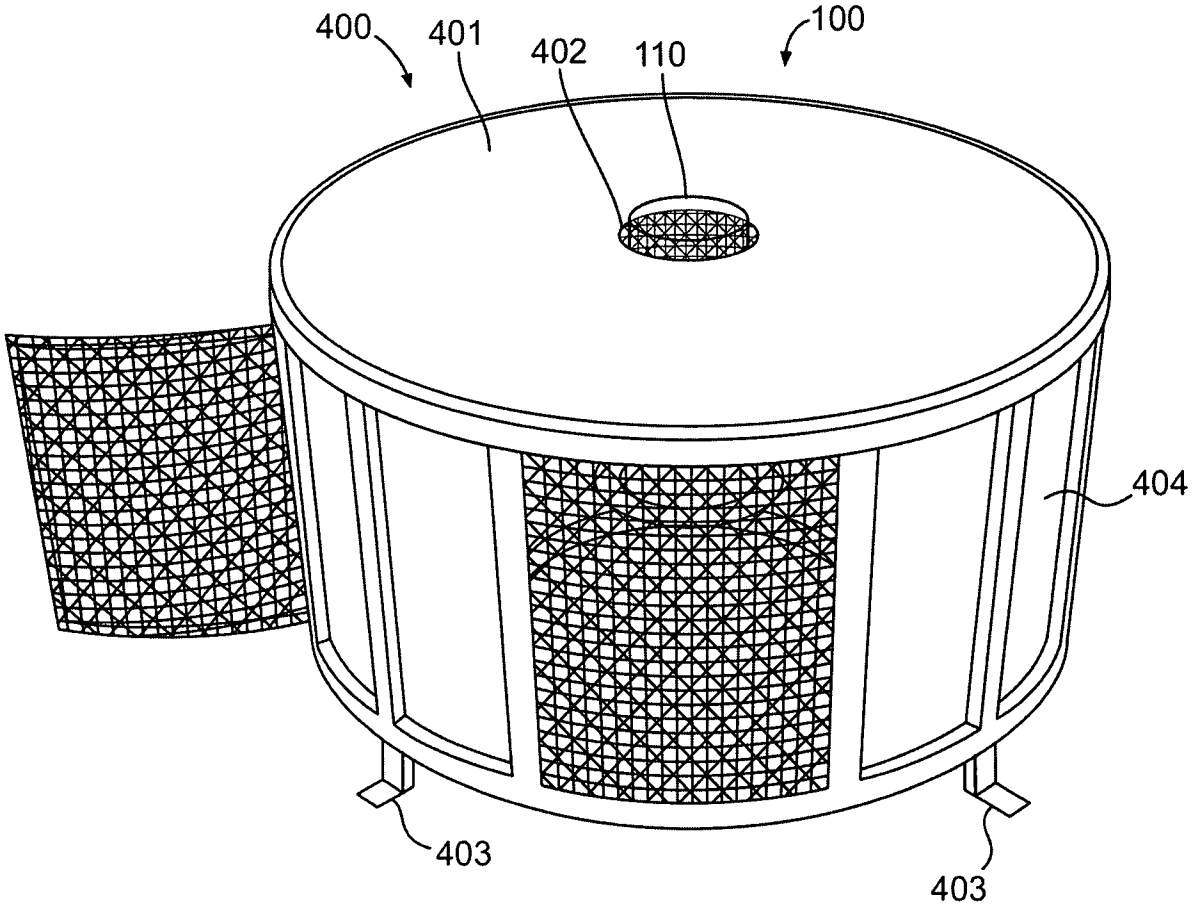
FIG. 11 is a perspective view of another table embodying the invention.

In one embodiment, shown in FIGS. 6 and 7, the gas feature 100 may include an integrated waterfall device 200. Waterfall device 200 is integrated into the gas feature 100 generally by connection or incorporation into a portion of base 120, such as stand 150. The waterfall device 200 may be formed by a waterfall surface 201 having or defining one or more water spillways 210 in an upper end of waterfall surface 201, through which water may pass and flow somewhat downwardly. The word "waterfall" in "waterfall surface" 201 is intended to convey a water channel having some degree of verticality by which the water may fall. Spillway 210 is intended to convey that water falls or spills at least in part from the force of gravity along waterfall surface 201. The waterfall surface 201 may include one or more corrugations 220 located below spillway 210, which will create a cascading effect as water flows over them.

The water may thus fall or flow from spillway 210 into a receptacle, such as water pump reservoir 240 (FIG. 6; FIG. 7). Water pump reservoir 240 is in fluid communication with a standard water pump (not shown), such as a magnetic drive or floating rotor pump similar to those used in ponds or fountains. Such pumps typically engage the waterfall device 200 and its body of water in a manner with a fluid intake in fluid communication with a lower portion or bottom of pump reservoir 240. Water pump reservoir 240 may be sized to hold the total desired quantity of water that, in operation, would circulate through the device. Thus, water may be pumped from pump reservoir 240 to circulate through tubing 250 (or other suitable fluid-communication conduit) up to spillways 210, passing through, and then falling to return to water pump reservoir 240. In other words, such a pump may have a discharge in fluid communication with tubing 250. Power cord 260 capable of electrically linking the waterfall device to a standard electrical power source (not shown). As may be seen in FIG. 7, a portion of the pump reservoir 240, and gas control valve 143 may be located in, and be accessible from, the rear of the device 300 in order to preserve the appearance of the waterfall and flame in the front of the device 300. Decorative pebbles 230, or similar objects, may be included in visible portions of water pump reservoir 240 (FIG. 6) if desired.

Light generated by flame 160 can thus reflect from the cascading water in a pleasing way.

In other embodiments, shown in FIGS. 8-11, device 100 may include an integrated table 400 having a top 401 defining a table top hole 402 (see FIG. 11), and having at least one leg 403 depending from and connecting to the table 400 for providing support thereto. The chimney 110 of device 100 may pass through hole 402, as illustrated. In some embodiments, the table top 401 may be fashioned from a transparent material in order to enhance the view of the chimney 110 and to make more of the flame visible to the observer. The table 400 may also include a casing 404 disposed about at least a portion of the base 120 and optionally conceals or partially conceals the base of the device 100 for aesthetic reasons. The casing 404 may also serve as a portion or all of stand 150 of the device 100, so long as the casing permits air to reach the plenum 130 (not visible). In general, casing 404 may be adapted to support the base 120. As shown in FIGS. 8 through 11, various types of table designs may be used. An aspect of some embodiments is that hole 402 and chimney 110 may be substantially centered on vertical axis 101.

Figure 12:
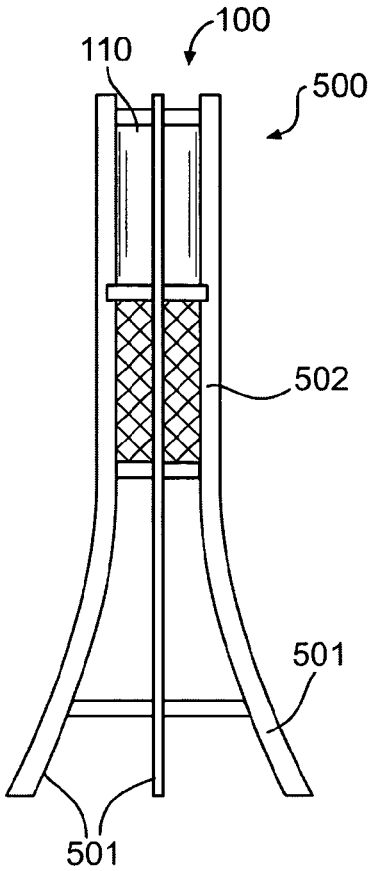
FIG. 12 is a side view of a torch embodying the present invention.

In another embodiment, shown in FIG. 12, device 100 may include integrated structure forming a torch 500 with supports 501. In this embodiment, the chimney 110 may be located near the top of the torch 500. The torch 500 may also include a casing 502 disposed about at least a portion of the base 120, and may contain and conceal or partially conceal the base 120 of the device 100 for aesthetic reasons. The casing 502 may also include a support surface or provide a portion of stand 150 of the device 100, so long as the casing permits air to reach the plenum 130 (not visible). As may be seen, a wide variety of styles of torches, supports 501, or casings 502 may also be used.

Figure 13:
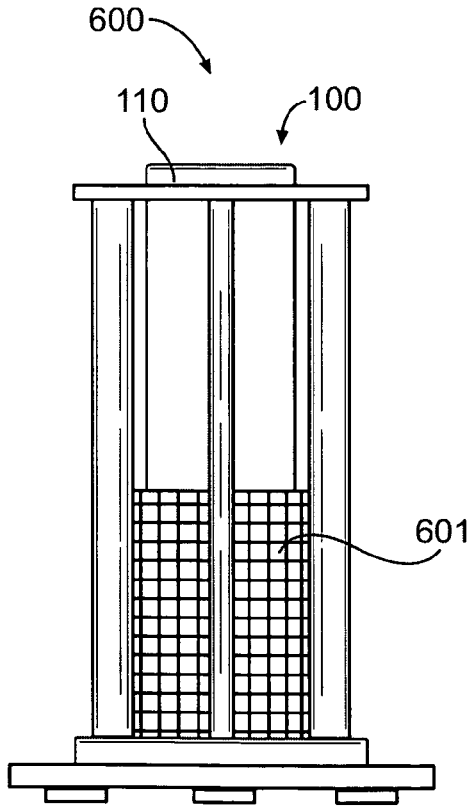
FIG. 13 is a side view of a lamp embodying the present invention.
Figure 14:
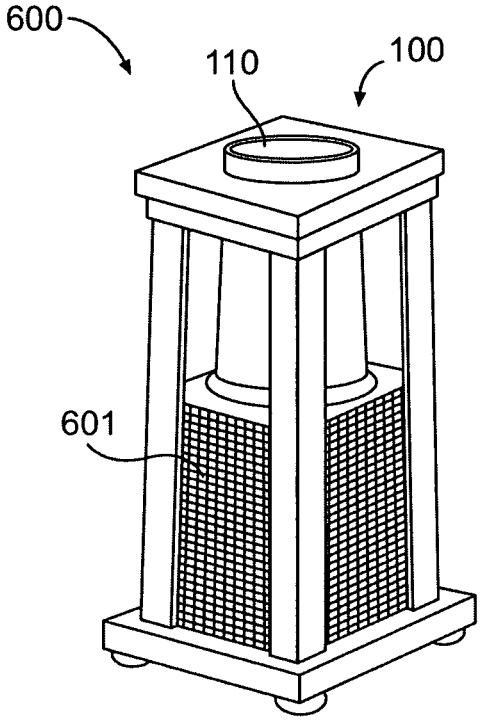
FIG. 14 is a perspective view of another lamp embodying the present invention.
Figure 15:
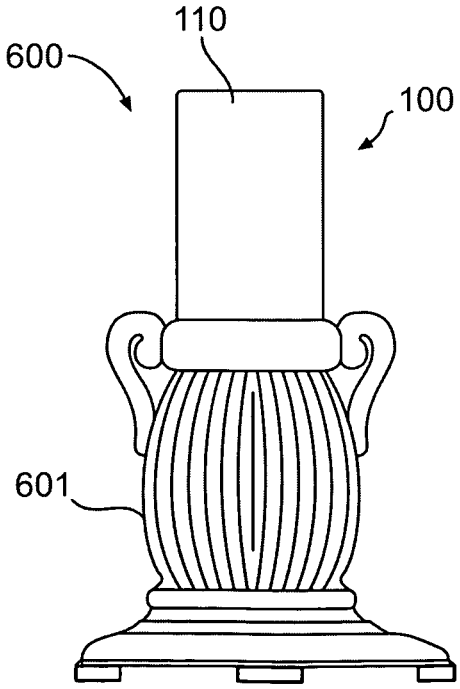
FIG. 15 is a side view of another lamp embodying the present invention.

In other embodiments, shown in FIGS. 13-15, device 100 may include integrated structure forming a lamp 600 that may be used, for example, on a table top. The lamp 600 includes a casing 601 may be disposed about at least a portion of base 120, and may contain and conceal or partially conceal the base 120 of the device 100 for aesthetic reasons. The casing 601 may also include a support surface or provide a portion or all of stand 150 of the device 100, so long as the casing permits air to reach the plenum 130 (not visible). The casing 601 may also partially conceal the chimney 110 (FIGS. 13-14) or alternatively permit the chimney 110 to be fully visible (FIG. 15). Many different lamp designs may be used.

Sample Embodiment

Gas Feature Device

In this example, an embodiment of the invention was made using steel, preferably stainless steel for some external applications, to construct the housing, plenum, and gas burner. Eight louvers having lengths of 4.8 centimeters and widths of 1.36 centimeters were machined into the plenum base, with each louver having an angled scoop creating a gap of about 5.3 millimeters between the scoop and the plenum base. A transparent chimney was employed in order to facilitate viewing of the flame created by the device.

The gas burner included stepped teeth, similar to those shown in FIG. 2, with each tooth having a burner port. Each burner port had a diameter of 2.5 millimeters and was located in the same position with respect to the rest of the tooth as shown. The embodiment was connected to a gas source having an outlet hole with a diameter of 0.66 millimeters. When the gas was ignited, a flame was produced having a swirling movement that was present throughout the height of the flame.

Similar efforts lacking either a chimney or the louvers produced a flame with little or no swirling effect, just a straight coalescing flame.

It is to be understood that the invention is not to be limited to the exact configuration as illustrated and described herein. Accordingly, all expedient modifications readily attainable by one of ordinary skill in the art from the disclosure set forth herein, or by routine experimentation therefrom, are deemed to be within the spirit and scope of the invention as defined herein. For example, although several device components in the exemplified embodiments are shown as circular, other shapes, such as rectangular and square, may also be used.

We claim:

1. A device using a natural draft to create a gas flame that swirls about a vertical axis, comprising:

a base comprising:

a stand having at least one support member defining an air passage in fluid communication with surrounding air, and a stand top defining an opening;

a plenum comprising a plenum top, a plenum base, and at least one side, the plenum top, plenum base, and at least one side defining a plenum chamber having a first effective diameter, the plenum being mounted on the top of the stand with the plenum base engaging the opening in the top of the stand;

wherein the plenum base defines a plurality of louvers or flaps that are disposed in the plenum base in a radial direction with respect to the vertical axis, with each louver or flaps defining a radial slit and a scoop depending from the plenum base along the length of the slit, establishing fluid communication between the stand opening and the plenum;

wherein the plenum top defines an outlet centered on the vertical axis, the outlet having a second effective diameter that is no greater than the first effective diameter;

a nozzle mix gas burner comprising a burner top, a bottom, and at least one side, the burner top, bottom, and at least one side defining a burner chamber having a third effective diameter and an outer surface with a perimeter, wherein the outer surface defines a plurality burner ports, each burner port having a central axis, with the burner ports angled so as to direct gas in a desired upward direction and a desired rotary direction with respect to the vertical axis;

a gas inlet tube in fluid communication with the burner chamber, the gas inlet tube connectable to a source of gas fuel;

wherein the third effective diameter is less than the first effective diameter, the burner is disposed within a lower portion of the plenum substantially centered on the vertical axis, leaving a desired portion of the plenum base exposed about the burner, and within which the plurality of louvers or flaps are disposed, with the plenum base further defining a passage adapted to receive the gas inlet tube;

a chimney having a fourth effective diameter and defining a vertical flue having an upper end and a lower end, the lower end of the flue operably engaged with the plenum outlet and in fluid communication with the plenum chamber, the chimney being substantially centered on the vertical axis;

wherein the scoops are inclined at such an angle, so that when air flows from the stand into the plenum via the louvers or flaps the air flow is angled in the same desired rotary direction as the gas flow along the central axis; and wherein the gas burner outer surface defines a plurality of upward projections, the upward projections comprising a plurality of stepped teeth disposed in a substantially circular manner about the perimeter of the gas burner outer surface, each of said stepped teeth having a rear incline and a front incline, and wherein the plurality of burner ports are defined in the front inclines of the stepped teeth.

2. The device of claim 1, wherein the burner ports and the scoops are oriented to direct gas and air flow in a clockwise direction.

3. The device of claim 1, wherein the burner ports and the scoops are oriented to direct gas and air flow in a counter-clockwise direction.

4. The device of claim 1, wherein the burner ports are oriented to direct gas at an angle of about 0-90 degrees from the radial separately or in combination with an angle of about 0-90 degrees from the vertical.

5. The device of claim 1, wherein the third effective diameter is less than the second effective diameter.

6. The device of claim 1, further comprising a vertical collar disposed about the plenum top outlet.

7. The device of claim 1, wherein the fourth effective diameter is greater than the second effective diameter.

8. The device of claim 1, wherein the fourth effective diameter is greater than the third effective diameter.

9. The device of claim 1, wherein the burner chamber, the plenum chamber, and the chimney are substantially cylindrical and substantially centered about the vertical axis.

10. The device of claim 1, wherein the plurality of burner ports are disposed in the at least one side of the burner.

11. The device of claim 1, wherein the plurality of burner ports are disposed in the top of the burner.

12. The device of claim 1, further comprising a piezoelectric starter disposed within the plenum chamber and outside of the burner chamber.

13. The device of claim 1, wherein each of the plurality of burner ports is consistently disposed in substantially the same location relative to each respective vertical projection.

14. The device of claim 1, wherein the chimney comprises a transparent material.

15. The device of claim 1, further comprising:

an integrated waterfall device connected to the base, forming at least one waterfall surface, and defining at least one spillway in an upper end of the at least one waterfall surface capable of spilling water along the waterfall surface in desired relation;

a water pump engaged with the waterfall device, capable of pumping water from a pump inlet and out a pump discharge;

a water pump reservoir capable of holding water; and wherein the water pump discharge is in fluid communication with the at least one spillway, the water pump reservoir is adapted to receive water spilling along the waterfall surface, and the water pump reservoir is in fluid connection with the water pump inlet.

16. The device of claim 15, wherein the at least one spillway comprises two or more spillways, and the integrated waterfall device further defines a central, somewhat vertical channel interposed vertically between two spillways, and wherein at least a portion of the chimney is positioned within the central channel.

17. The device of claim 15, wherein the waterfall surface defines a plurality of somewhat horizontal corrugations.

18. The device of claim 1, wherein the base further comprises an integrated casing disposed about at least a portion of the base, the casing having at least one casing support surface for supporting the base without preventing the stand's fluid communication with surrounding air, and one or more legs connected to and depending from the casing, thereby elevating the device in the manner of a torch.

19. The device of claim 1, further comprising:

an integrated table having a casing disposed about at least a portion of the base, and adapted to support the base without preventing the stand's fluid communication with surrounding air, the table further comprising:

a substantially horizontal table top, the table top defining a horizontal hole positioned in the table top proximate the casing and centered on the vertical axis;

at least one leg depending from and connecting to the table for providing support thereto; and wherein the chimney is substantially centered on the vertical axis and passes through the hole in the table top.

20. The table and decorative gas feature combination of claim 19, wherein the table top comprises a transparent material.

21. A device using a natural draft to create a gas flame that swirls about a vertical axis, comprising:

a base comprising, a stand having at least one support member defining an air passage in fluid communication with surrounding air and a stand top defining an opening;

a plenum comprising a plenum top, a plenum base, and at least one side, the plenum top, plenum base, and at least one side defining a plenum chamber having a first effective diameter, the plenum being mounted on the top of the stand with the plenum base engaging the opening in the top of the stand;

wherein the plenum base defines a plurality of louvers or flaps that are disposed in the plenum base in a radial direction with respect to the vertical axis, with each louver or flap defining a radial slit and a scoop depending from the plenum base along the length of the slit, establishing fluid communication between the stand opening and the plenum;

wherein the plenum top defines an outlet centered on the vertical axis, the outlet having a second effective diameter that is no greater than the first diameter, and further comprising a vertical collar disposed about the plenum top outlet;

a nozzle mix gas burner comprising a burner top, a bottom, and at least one side, the burner top, bottom, and at least one side defining a burner chamber having a third effective diameter and an outer surface with a perimeter, wherein the outer surface defines a plurality burner ports, each burner port having a central axis, with the burner ports angled so as to direct gas in a desired upward direction and a desired rotary direction with respect to the vertical axis, and further wherein the gas burner outer surface defines a plurality of upward projections, the upward projections comprising a plurality of stepped teeth disposed in a substantially circular manner about the perimeter of the gas burner outer surface, each of said stepped teeth having a rear incline and a front incline, and wherein the plurality of burner ports are defined in the front inclines of the stepped teeth;

a gas inlet tube in fluid communication with the burner chamber, the gas inlet tube connectable to a source of gas fuel;

wherein the third effective diameter is less than the first effective diameter and the second effective diameter, the burner is disposed within a lower portion of the plenum substantially centered on the vertical axis, leaving a desired portion of the plenum base exposed about the burner, and within which the plurality of louvers or flaps are disposed, with the plenum base further defining a passage adapted to receive the gas inlet tube;

a chimney having a fourth effective diameter and defining a vertical flue having an upper end and a lower end, the lower end of the flue operably engaged with the plenum outlet and in fluid communication with the plenum chamber, the chimney being substantially centered on the vertical axis; and wherein the scoops are inclined at such an angle, so that when air flows from the stand into the plenum via the louvers or flaps the air flow is angled in the same desired rotary direction as the gas flow along the central axis.

22. A device using a natural draft to create a gas flame that swirls about a vertical axis, comprising:

a base comprising, a stand having at least one support member defining an air passage in fluid communication with surrounding air and a stand top defining an opening;

a plenum comprising a plenum top, a base, and at least one side, the plenum top, base, and at least one side defining a plenum chamber having a first effective diameter, the plenum being mounted on the top of the stand with the plenum base engaging the opening in the top of the stand;

wherein the plenum base defines a plurality of louvers or flaps that are disposed in the plenum base in a radial direction with respect to the vertical axis, with each louver or flap defining a radial slit and a scoop depending from the plenum base along the length of the slit, establishing fluid communication between the stand and the plenum;

wherein the plenum top defines an outlet centered on the vertical axis, the outlet having a second effective diameter that is no greater than the first diameter;

a gas burner comprising a burner top, a bottom, and at least one side, the burner top, bottom, and at least one side defining a burner chamber having a third effective diameter and an outer surface with a perimeter, wherein the outer surface defines a plurality burner ports, each burner port having a central axis, with the burner ports angled so as to direct gas in a desired upward direction and a desired rotary direction with respect to the vertical axis, and;

a gas inlet tube in fluid communication with the burner chamber, the gas inlet tube connectable to a source of gas fuel;

wherein the burner is disposed within a lower portion of the plenum substantially centered on the vertical axis, leaving a desired portion of the plenum base exposed about the burner, and within which the plurality of louvers or flaps are disposed, with the plenum base further defining a passage adapted to receive the gas inlet tube;

a chimney having a fourth effective diameter and defining a vertical flue having an upper end and a lower end, the lower end of the flue operably engaged with the plenum outlet and in fluid communication with the plenum chamber, the chimney being substantially centered on the vertical axis and the fourth effective diameter being greater than the second and third effective diameters;

wherein the scoops are inclined at such an angle, so that when air flows from the stand into the plenum via the louvers or flaps the air flow is angled in the same desired rotary direction as the gas flow along the central axis; and wherein the gas burner outer surface defines a plurality of upward projections, the upward projections comprising a plurality of stepped teeth disposed in a substantially circular manner about the perimeter of the gas burner outer surface, each of said stepped teeth having a rear incline and a front incline, and wherein the plurality of burner ports are defined in the front inclines of the stepped teeth.

* * * * *